US006383003B1

(12) United States Patent
Corona

(10) Patent No.: US 6,383,003 B1
(45) Date of Patent: May 7, 2002

(54) ENVIRONMENTALLY SEALED CONNECTOR SYSTEM

(76) Inventor: Sergio Corona, 1340 Shelley Ave., Upland, CA (US) 91786

( * ) Notice: Subject to any disclaimer, the term of this patent is extended or adjusted under 35 U.S.C. 154(b) by 0 days.

(21) Appl. No.: 09/453,347

(22) Filed: Dec. 1, 1999

(51) Int. Cl.[7] ..... H01R 13/52

(52) U.S. Cl. ..... 439/278; 439/278; 439/548; 439/556; 439/106; 439/353; 439/588

(58) Field of Search ..... 439/278, 548, 439/549, 550, 551, 552, 553, 554, 555, 556, 557, 60, 924.1, 106, 559, 283, 353, 357, 588–592

(56) References Cited

U.S. PATENT DOCUMENTS 4,018,492 A * 4/1977 Eckart ..... 339/14
4,637,674 A 1/1987 Kobler
5,037,325 A * 8/1991 Wirkus ..... 439/467
5,120,237 A 6/1992 Fussell
5,401,181 A 3/1995 Wilson
D360,871 S 8/1995 Wilson
D360,872 S 8/1995 Wilson
5,957,715 A 9/1999 Fukuda
6,080,004 A 6/2000 Kovacik et al.

* cited by examiner

*Primary Examiner*—Tho D. Ta
*Assistant Examiner*—Truc Nguyen
(74) *Attorney, Agent, or Firm*—Collard & Roe, P.C.

(57) ABSTRACT

An environmentally sealed electrical connector system for connector boxes used in the proximity of water includes an anchored connector which mounts into the face plate of the box from the rear, to facilitate making wiring connections in the box before installing the face plate. A mating plug-in connector forms an environmental seal around the connector contacts when mated with the anchored connector, and locking arms secure the plug-in connector to the face plate when mated. A two-piece construction allows the plug-in connector to have hard portions for locking, and soft portions for sealing.

3 Claims, 6 Drawing Sheets

ENVIRONMENTALLY SEALED CONNECTOR SYSTEM

FIELD OF THE INVENTION

This invention relates to environmentally sealed electrical connectors, and more particularly to improved connectors which facilitate installation of equipment boxes in spas, pools, washing machines and the like, and which are resistant to accidental disconnection.

BACKGROUND OF THE INVENTION

U.S. Pat. No. 5,401,181 to Wilson discloses an environmentally sealed electrical connector system in which mating female and male connectors are provided, respectively, with a bead and groove that cooperate, when the connectors are mated, to form a moisture-tight seal around the mating contacts. One of the uses of the connector system of U.S. Pat. No. 5,401,181 involves a connection box for spas, washers or the like, in which one of the connectors is anchored in the face plate of the box, and the other is used to plug an external cable into the anchored connector. For this purpose, the anchored connector takes the form shown in U.S. Pat. No. Des. 360,871 to Wilson.

In the Wilson system, the female connector of U.S. Pat. No. 5,401,181 is anchored in the face plate by threading the wires or cable attached to it from the front through precut openings in the face plate, and then pushing the connector into the opening until the wedge-shaped teeth shown in U.S. Pat. No. Des. 360,871 catch on the back side of the face plate and lock the anchored connector to the face plate.

It has been found in practice that although the system of U.S. Pat. No. 5,401,181 and U.S. Pat. No. Des. 360,871 performs adequately, it is not entirely satisfactory in two respects. First, because the anchored connector of U.S. Pat. No. Des. 360,871 must be inserted from the front of the face plate, the wires attached to it must be connected inside the box with the face plate present. This causes problems because work space inside the box is limited (particularly if more than one anchored connector is provided), and the handling and movement of the face plate and anchored connectors during connection work frequently causes paint scratches and dirt stains on the face plate.

Another problem with the prior art system is that the wires or cable attached to the plug-in (usually the male) connector are sometimes subjected, in tight places, to a bending stress that causes the male and female connectors to become misaligned, and thereby to jeopardize the moisture seal even if the connectors do not become completely disconnected.

SUMMARY OF THE INVENTION

The present invention overcomes the drawbacks of the prior art by providing a connector system in which an anchored connector can be inserted through a cutout in the face plate of a box, from the rear of the face plate, after the wiring connections have been made outside of the box. Furthermore, in accordance with the invention, the plug-in connector is equipped with one or more resilient hooked arms that lockingly engage the face place cutouts when the connectors are mated. The locking of the plug-in connector to the face plate prevents the plug-in connector from becoming misaligned or detached from the anchored connector.

In other aspects of the invention, the plug-in connector is formed of two different materials to provide both a firm lock to the face plate, and a soft exterior hood for an effective moisture seal. Also, provision is made for the ground contact to extend farther outward from the connectors than the hot contacts, so that the ground connection will be made first when the connectors are mated.

DESCRIPTION OF THE PREFERRED EMBODIMENT

Figure 1:
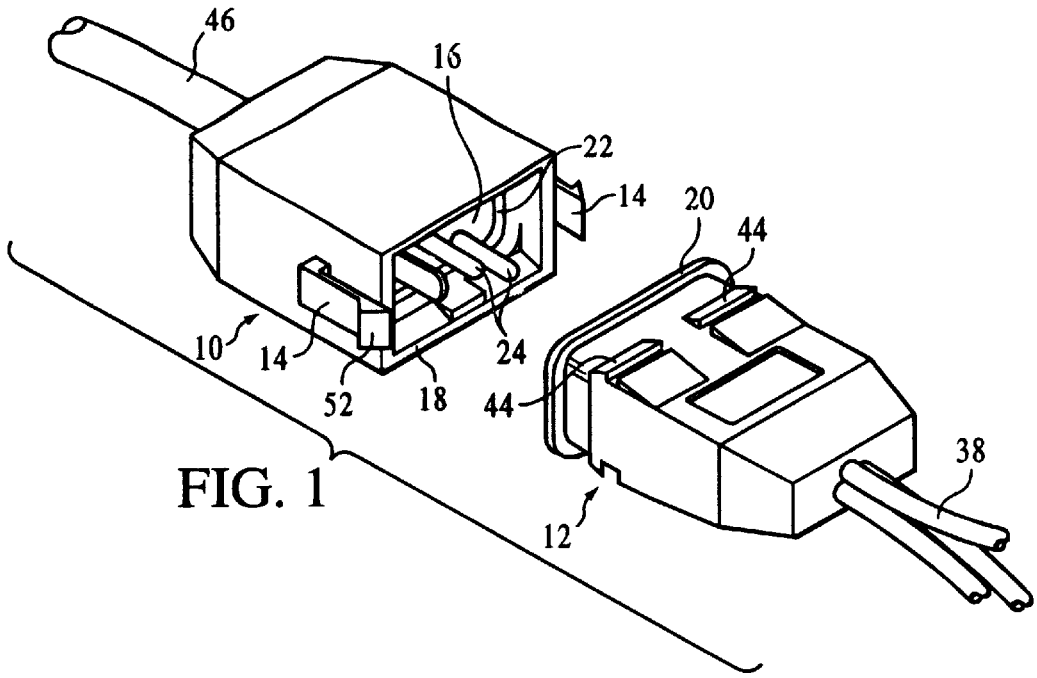
FIG. 1 is a perspective view of the connectors of this invention.
Figure 2A:
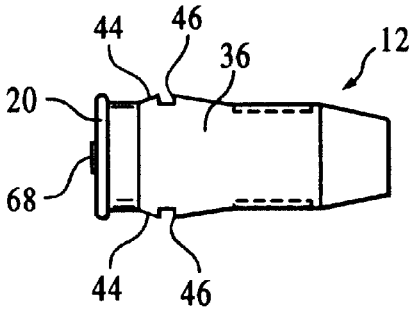
FIGS. 2*a–c* are a side elevation, broken-away top view and front elevation, respectively, of the female connector.
Figure 2B:
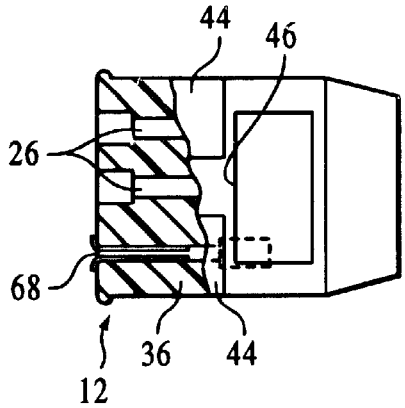
Figure 2C:
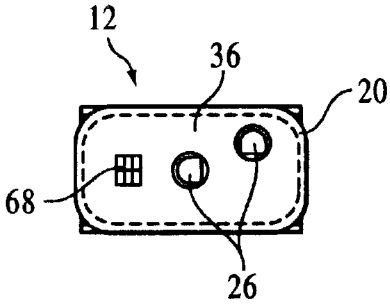

FIG. 1 shows the connectors 10, 12 of this invention. Although either of the connectors 10, 12 may be the male or female, it will be assumed in the following discussion that the plug-in connector 10 is the male, and that the anchored connector 12 is the female. The plug-in connector 10 includes, as discussed in more detail below, a pair of locking arms 14, a contact block 16, and a resilient hood 18 that sealingly surrounds the outer end of the anchored connector 12 when the connectors 10, 12 are mated. As shown in U.S. Pat. No. 5,401,181, one of the connectors 10, 12 includes an annular ridge 20 which cooperates with a matching groove 22 in the other connector to produce a moisture-proof seal around the contacts 24, 26 (the latter shown in FIGS. 2*b* and 2*c*) when the connectors 10, 12 are mated.

Figure 1A:
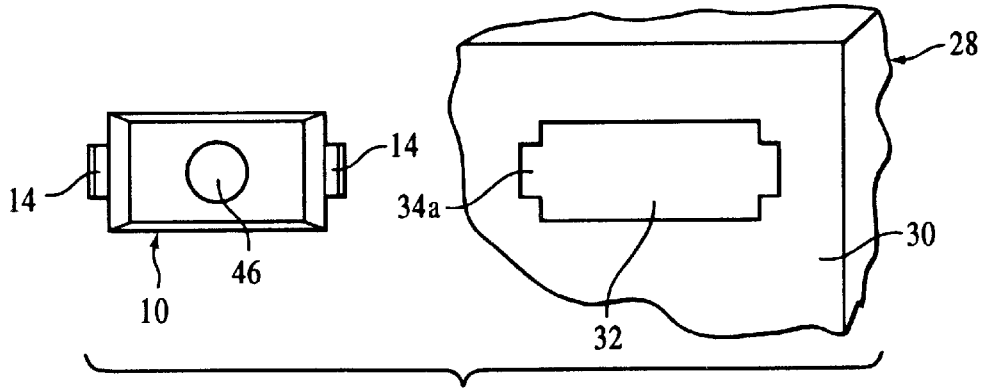
FIGS. 1*a* and 1*b* illustrate two versions of the environment in which the invention is useful.
Figure 1B:
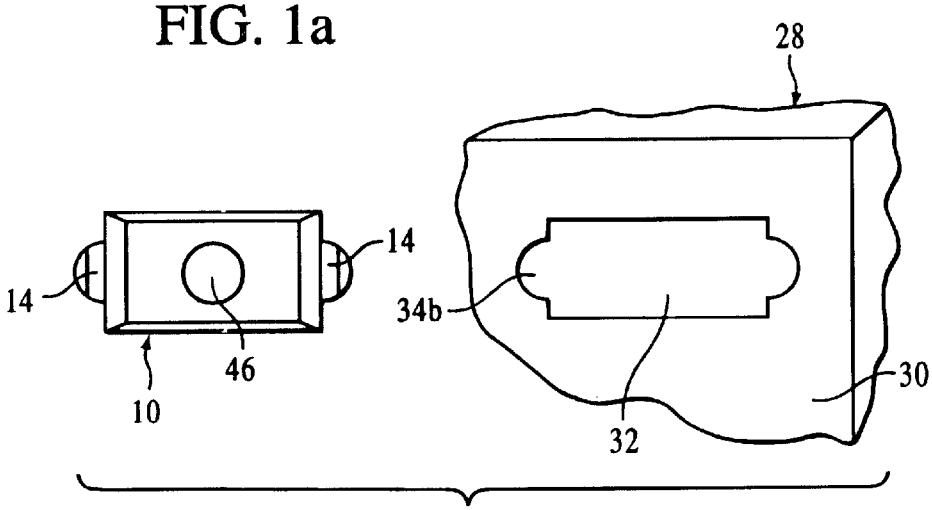

FIGS. 1*a* and 1*b* illustrate an environment in which the connector system of this invention is particularly useful. Moisture-proof connection boxes 28 are used in many environments and appliances where the presence of water presents a potential shock, corrosion and/or short circuit hazard. Typically, such boxes contain wiring interconnections, and they are closed off by a face plate 30. The face plate 30 typically forms a seal with the box 28 to prevent moisture from entering the box 28. The face plate 30 is also typically provided with cutouts 32 of standard dimensions. The cutouts 32 are usually rectangular in shape and have ears 34*a*, 34*b* that may be square (FIG. 1*a*) or rounded (FIG. 1*b*).

Figure 3A:
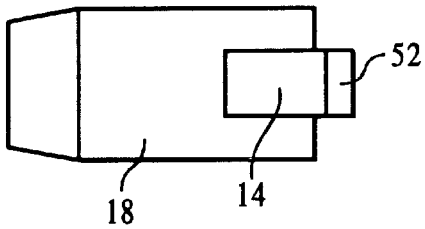
FIGS. 3*a–c* are like views of the male connector.
Figure 3B:
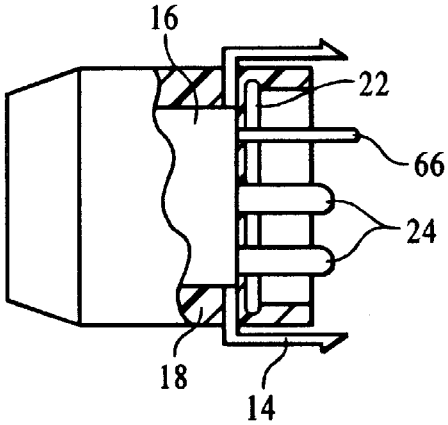
Figure 3C:
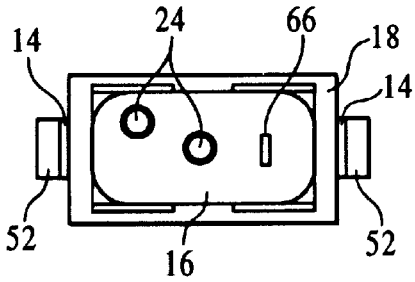

For use in the above-described environment, the anchored connector 12 has a body 36 (FIGS. 2*a–c*) of resilient polyvinyl chloride (PVC) material that is conventionally molded around the female contacts 26 after the wires 38 (FIG. 1) have been attached to them. At its outer or forward end, the anchored connector 12 carries a bead 20 which interacts with the groove 22 (FIG. 3*a–c*) of the plug-in connector 10 to form an annular moisture seal in the manner described in U.S. Pat. No. 5,401,181. Adjacent to its front end, the anchored connector 12 is equipped with wedge-shaped protrusions 44 which deform as the connector 12 is passed through the cutout 32 (FIGS. 1*a*, 1*b*) from the rear of the face plate 30, and then snap back to prevent rearward movement of the connector 12. In that condition, the connector 12 is anchored in the face plate 30 by the protrusions 44 and the wall 46 formed in the body 36.

Figure 4A:
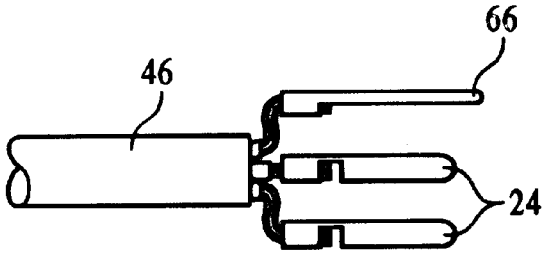
FIGS. 4*a–c* illustrate sequential steps in the fabrication of the male connector.
Figure 4B:
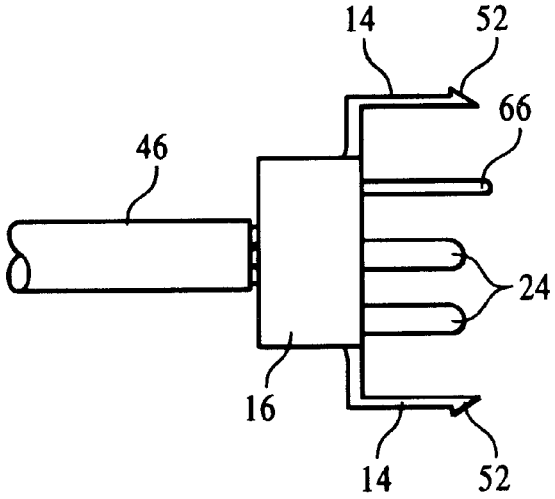

The plug-in connector 10 is fabricated, according to the invention, in a two-step process. The male contacts 24, with the cable 46 attached (FIG. 4*a*) are placed in a jig (not shown), and a contact block 16 of nonconductive polystyrene is formed around them (FIG. 4*b*). The block 16 has a pair of arms 14 formed integrally with it. The arms 14 carry locking hooks 52 at their ends. Although the material of block 16 is quite hard, it has sufficient resiliency to allow the arms 14 to bend to a small degree. Thus, when the connectors 10, 12 are mated, the locking hooks 52 can pass through the ears 34*a* or 34*b* of the cutouts 32, and then spring outwardly behind the face plate 30 to lock the connector 10 in place. Because it is desirable to fill the cutout 32 as much as possible, the arms 14 and hooks 52 preferably have a cross section corresponding to the square (FIG. 1*a*) or rounded (FIG. 1*b*) shape of the ears 34*a*, 34*b*.

Figure 4C:
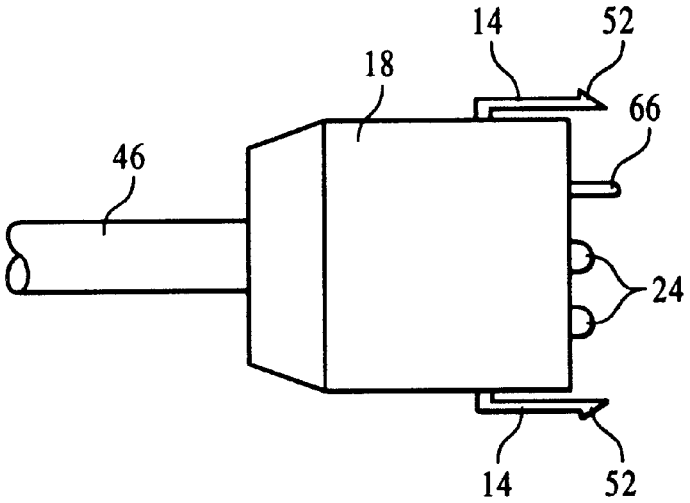

The fabrication of plug-in connector 10 continues by placing the block 16 into a mold (not shown), and forming around it a soft, resilient hood 18 of PVC, preferably the same material as the body of the anchored connector 12 (FIG. 4*c*), and softer than the material of hook 52. The hood 18 is shaped to engage and surround the forward end of connector 12, and to lie sealingly against the face plate 30 when the connectors 10, 12 are mated to the point where the annular groove 22 inside the hood 18 sealingly engages the bead 20 of the connector 12. It is to be noted that the arms 14 are positioned laterally outwardly of the hood 18 so as to be flexible independently of the hood 18.

Figure 5A:
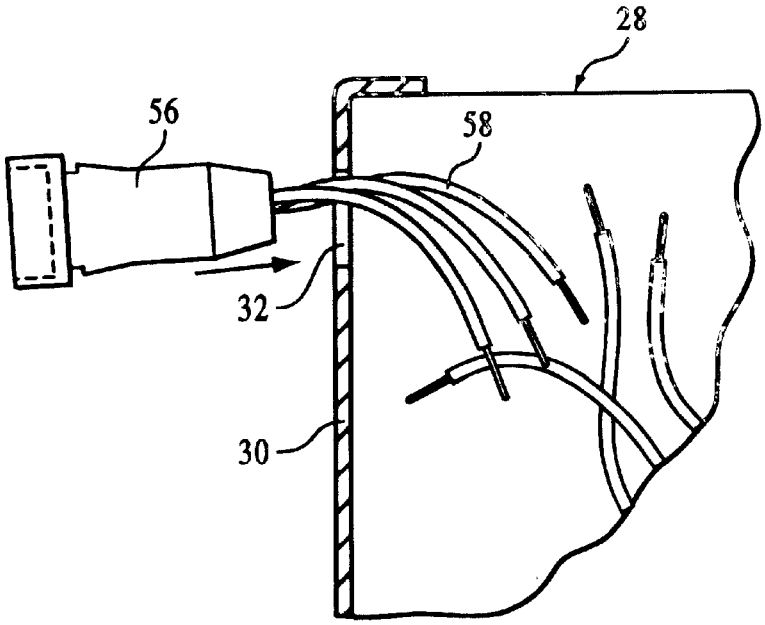
FIG. 5a PRIOR ART
FIGS. 5*a* and 5*b* illustrate the installation of prior art connectors in a connection box.
Figure 5B:
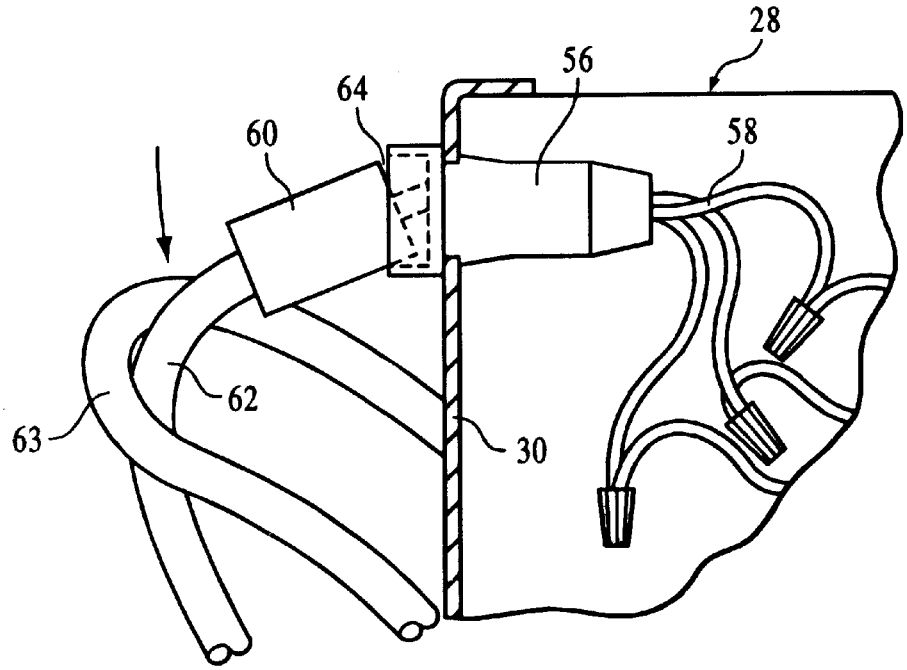
FIG. 5b PRIOR ART

FIGS. 5*a, b* and 6*a, b* illustrate the installation of a connector system in the face plate 30 of a connection box 28. In the prior art (FIGS. 5*a, b*), the female connector 56 of the Wilson patents was inserted through the cutout 32 from the front of the face plate 30 prior to connection of its wires 58 (FIG. 5*a*). The connections inside the box 28 were then made with the face plate 30 present. The presence of the face plate 30 not only made connection work inside the box 28 more awkward, but it also sometimes resulted in damage to the finish of face plate 30. When the male connector 60 of the prior Wilson patents' system was plugged into the connector 56 (FIG. 5*b*), a downward stress on the cable 62 (as, for example, by other cables 63) easily resulted in the formation of a moisture-admitting gap 64, or even a disconnection of the connectors 56, 60.

Figure 6A:
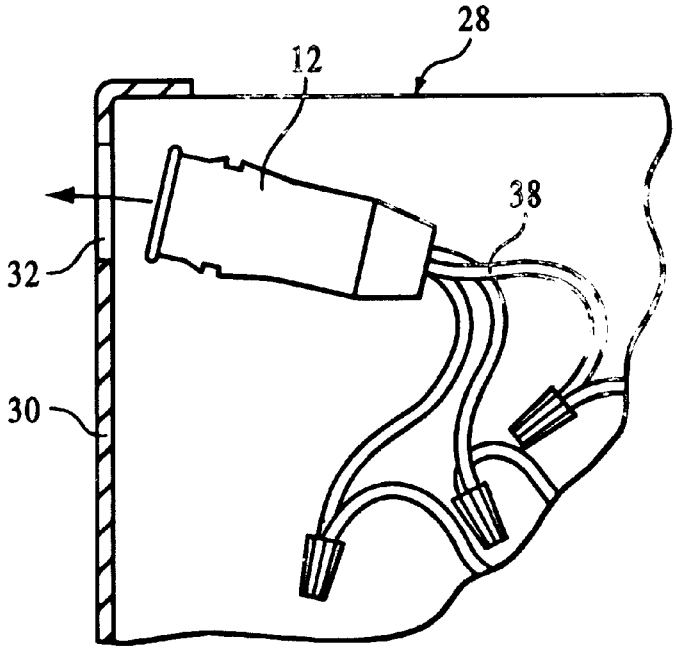
FIGS. 6*a* and 6*b* illustrate the installation of the inventive connectors in a connection box.
Figure 6B:
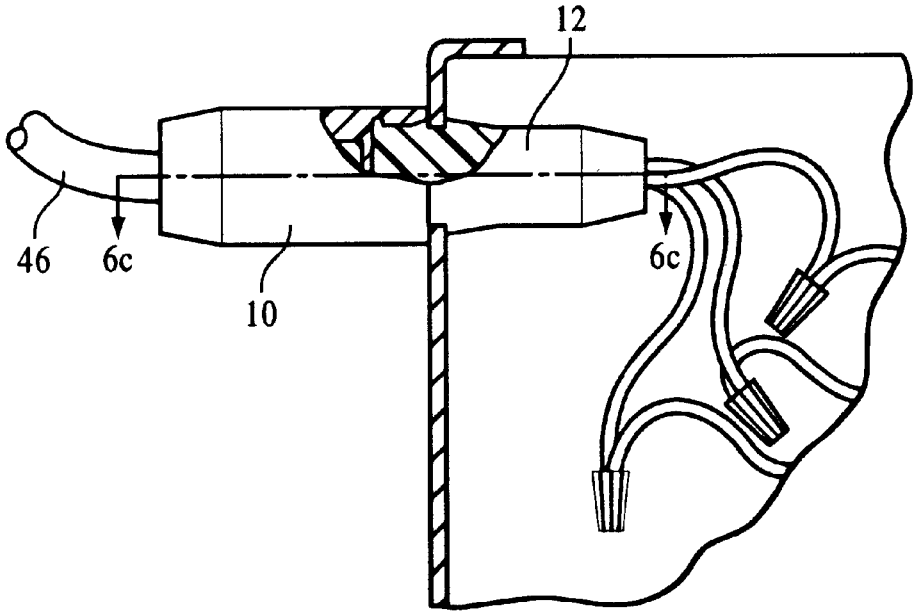
Figure 6C:
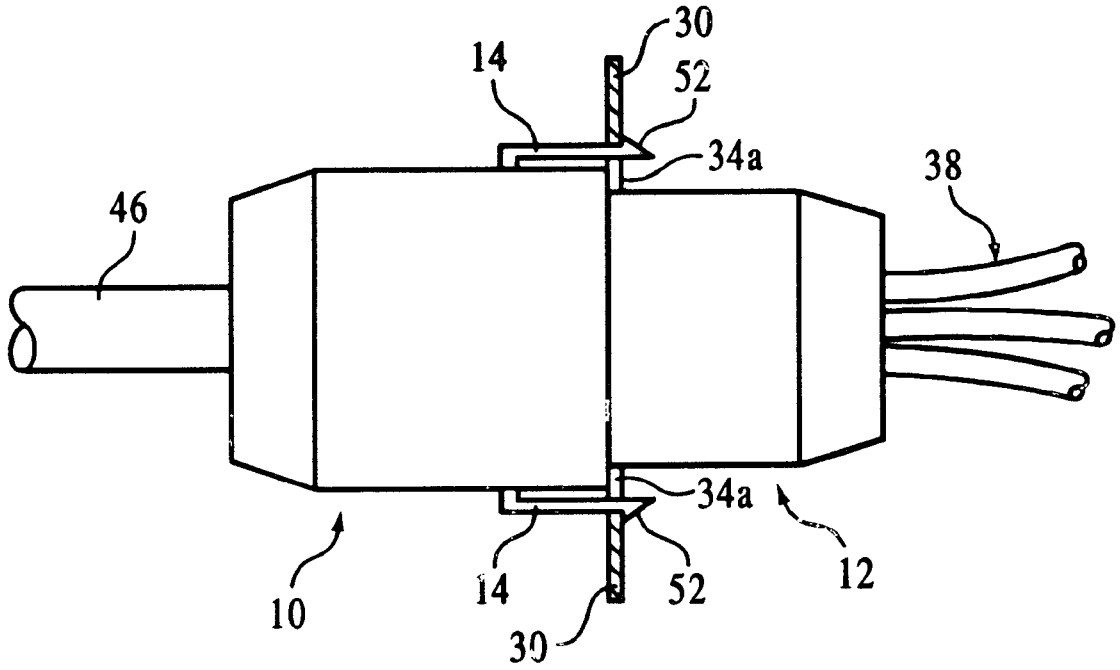
FIG. 6*c* is a horizontal section along line 6*c*—6*c* of FIG. 6*b*, but with the interior details of the connectors 10 and 12 omitted.

By contrast, in the inventive system (FIGS. 6*a–c*), the connection of wires 38 inside the box 28 is done first, without the face plate 30 being present. When all the connections have been made, the anchored connectors 12 are inserted into the face plate 30 from the rear (FIG. 6*a*), and the face plate 30 is attached to the box 28. The connectors 10 10 can now be plugged into the connectors 12, and as the arms 14 engage the face plate 30 with their hooks 52 (FIG. 6*c*), the connectors 10, 12 cannot be separated or misaligned by a downward or sideways stress on the cable 46.

One of the features of the present invention is that during the mating of the connectors 10, 12, the ground connection is made before the connection of the hot contacts 24, 26, and that during the disengagement of connectors 10, 12, the ground connection is not broken until after the hot contacts 24, 26 have separated. For that purpose, at least one of the ground contacts 66, 68, and preferably both, extends farther outwardly of its respective connector 10, 12 as best shown in FIGS. 3*b*, 4*c*, 2*a* and 2*b*.

It is understood that the exemplary environmentally sealed connector system described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A connector system for making environmentally sealed electrical connections to a connection box having cutouts in a face thereof for receiving elements of said connector system, comprising:

a) a first connector configured to be lockingly inserted into said face of said box from a rear side of said face through said cutout;

b) a second connector configured to engage said first connector from a front side of said face;

c) said second connector having at least one hook arranged to releasably lockingly engage said cutout when said second connector is engaged with said first connector;

d) said connectors being formed of resilient materials and being configured to engage each other and said face of said box around said cutout in environmentally sealed relationship when said hook is lockingly engaged with said cutout;

wherein said hook is formed of a first material which is resilient but hard;

wherein said hook forms an extension of a contact-securing block in said second connector, and said block is encased in a hood of said second material which is resilient and softer than said first material, said hood being adapted to engage said first connector.

2. The connector system of claim 1, in which said first and second connectors carry mating male and female contacts, one of which is a set of ground contacts; at least one of said ground contacts extending farther outwardly of its connector than the other contacts, so that the ground connection is made first when said connectors are engaged.

3. The connector system of claim 1, in which one of said connectors carries an annular groove, and the other carries an annular bead, said groove and bead being positioned so as to mate, when said connectors are fully engaged, to form an environmental seal around said contacts.

* * * * *